US011807448B2

(12) United States Patent
Lauga et al.

(10) Patent No.: US 11,807,448 B2
(45) Date of Patent: Nov. 7, 2023

(54) FLEXIBLE TANK

(71) Applicant: Avon Engineered Fabrications, LLC, Picayune, MS (US)

(72) Inventors: Trinity Lauga, Mandeville, LA (US); Richard Heath, North-Kingstown, RI (US); Robert Homes, Long Beach, MS (US); Joshua Butler, Ocean Springs, MS (US)

(73) Assignee: Avon Engineered Fabrications, LLC, Picayune, MS (US)

( * ) Notice: Subject to any disclaimer, the term of this patent is extended or adjusted under 35 U.S.C. 154(b) by 389 days.

(21) Appl. No.: 17/028,589

(22) Filed: Sep. 22, 2020

(65) Prior Publication Data

US 2022/0089358 A1 Mar. 24, 2022

(51) Int. Cl.

| | |
|---|---|
| ***B65D 88/22*** | (2006.01) |
| ***B65D 88/16*** | (2006.01) |
| ***B65D 90/00*** | (2006.01) |
| ***B65D 90/02*** | (2019.01) |

(52) U.S. Cl.

CPC ..... *B65D 88/22* (2013.01); *B65D 88/1637* (2013.01); *B65D 88/1656* (2013.01); *B65D 88/1687* (2013.01); *B65D 90/0033* (2013.01); *B65D 90/021* (2013.01); *B65D 2588/162* (2013.01); *B65D 2588/54* (2013.01)

(58) Field of Classification Search

CPC ..... B65D 88/22; B65D 88/1637; B65D 88/1656; B65D 88/1687; B65D 90/0033; B65D 90/021

See application file for complete search history.

(56) References Cited

U.S. PATENT DOCUMENTS

| | | | | |
|---|---|---|---|---|
| 648,182 | A * | 4/1900 | Webb | B65D 3/08 229/116.1 |
| 2,851,075 | A * | 9/1958 | Palfey | B65D 88/22 220/666 |
| 3,097,677 | A * | 7/1963 | Mitchell | B65D 88/1637 220/86.1 |
| 3,774,812 | A * | 11/1973 | Lemelson | B65D 88/1637 222/211 |
| 10,730,730 | B2 * | 8/2020 | Mueller | B66F 11/04 |
| 2001/0032846 | A1 * | 10/2001 | Joshi | B65D 88/1668 220/4.13 |
| 2013/0020331 | A1 * | 1/2013 | Davis | E02B 3/10 220/565 |
| 2020/0123725 | A1 * | 4/2020 | Adams | B65D 88/1625 |

* cited by examiner

*Primary Examiner* — Derek J Battisti

(74) *Attorney, Agent, or Firm* — The Watson IP Group, PLC; Jovan N. Jovanovic

(57) ABSTRACT

A flexible tank fillable with a liquid having a base and at least one enclosing wall. The base has an upper surface and a lower surface, and defines a plurality of edges and a perimeter. The enclosing wall extends about the base and is attached thereto to, together with the base, define an enclosure. The inner brace assembly comprises at least one inner support member having a base wall attachment side and an encasing wall attachment side. The base wall attachment side is attached to the base spaced apart from the perimeter. The encasing wall attachment side is attached to the at least one enclosing wall spaced apart from the base fold.

15 Claims, 12 Drawing Sheets

FLEXIBLE TANK

CROSS-REFERENCE TO RELATED APPLICATION

NA

BACKGROUND OF THE DISCLOSURE

1. Field of the Disclosure

The disclosure relates in general to a large containers for storing fluids among other materials, and more particularly, to a flexible tank. Such a flexible tank may be used to store, for example, drinking water. Of course, this is exemplary only, and, is not deemed to be limiting, as the flexible tank can be used for other purposes.

2. Background Art

Tanks for the storage of different materials is known. Some such tanks are flexible in nature and can be utilized to store liquids, including but not limited to water, fuel, chemicals, gels, suspensions, among other, typically flowable material termed liquids (wherein the term fluid comprises a liquid in the definition of one of the four fundamental states of matter). Such flexible tanks are often made of a woven fabric made from fibers (typically a polymer such as nylon) and coated with polymers (such as polyurethane of polyethylene, among others). These materials are exemplary and not to be deemed limiting. Such woven fabrics have a number of different types, weights, configurations, and materials. The woven fabrics are typically provided in rolls of fabric that is cut and seamed through techniques such as heat, RF welding, among other techniques known to those of skill in the art (for purposes of the present application, the term welding will be understood to mean any number of joining techniques, including but not limited to those identified in this paragraph or elsewhere in the disclosure).

In contrast to steel tanks, flexible tanks are relatively easy to transport, unfold, and deploy. These features make them popular and well suited for applications in remote locations and temporary installations, such as military installations and for emergency services (while not being limited to either).

Known flexible tanks typically have open and closed tops, and are often round in construction. One such known tank is sold under the name Onion Tanks available from SEI Industries LTD of British Columbia, Canada. Such tanks are often utilized by the U.S. Department of Defense (DOD) for the purpose of generating large quantities of drinking water by way of a Reverse Osmosis Water Purification Unit (ROWPU). These drinking water production systems typically utilize 3,000-gallon flexible tanks to hold both pre and post treated water.

Problematically, due to military specifications which require the use of such flexible tanks on inclines up to 10%, the prior art construction has been directed to tanks that have a circular base with conical or frustoconical upstanding enclosure walls. The circular base reduce the risk of a flexible bag rolling down an incline during filling, so as to be able to meet the military specifications. On the other hand, such circular bases typically have less efficiency, require the increased use of material and are therefore suboptimal.

SUMMARY OF THE DISCLOSURE

The disclosure is directed to a flexible tank fillable with a liquid comprising a base, at least one enclosing wall, and an inner brace. The base has an upper surface and a lower surface, the base defining a plurality of edges and a perimeter. The at least one enclosing wall extends about the base and is attached thereto to, together with the base, define an enclosure. The inner brace assembly comprises at least one inner support member having a base wall attachment side and an encasing wall attachment side. The base wall attachment side is attached to the base spaced apart from the perimeter. The encasing wall attachment side is attached to the at least one enclosing wall spaced apart from the base fold.

In some configurations, the at least one inner support member is placed in tension during filling with a liquid and may be released of tension by further filling with a liquid.

In some such configurations, when the flexible tank filled to a predetermined level with a liquid the at least one inner support member is in less tension that during filling.

In some configurations, when the base is on a flat surface, the at least one inner support member is not in tension throughout the filling of the enclosure with a liquid to a predetermined level.

In some configurations, the base comprises a rectangular configuration wherein the at least one edge comprises four edges. The at least one enclosing wall comprise four enclosing walls, each having a base fold meeting a respective one of the four edges, and each having opposing attaching edges extending therefrom toward a distal end. The opposing edges have an outwardly convex configuration and adjacent ones of opposing attaching edges of adjacent enclosing walls are attached to each other to define the enclosure.

In some configurations, the at least one inner support member comprises at least two inner support members extending from the base to at least one of the four enclosing walls.

In some configurations, the at least one inner support member comprises at least two inner support members extending from the base to at least two of the four enclosing walls.

In some configurations, the at least one inner support member comprises at least two inner support members extending from the base to each of the four enclosing walls.

In some configurations, the at least two inner support members comprise elongated strips of a woven fabric.

In some configurations, each of the four enclosing walls are substantially identical in configuration, with the base comprises a square.

In some configurations, the flexible tank further includes an opening assembly comprising a chute having a proximal end attached to at least one enclosing wall and a distal end spaced therefrom. The chute defines an elongated channel placeable in fluid communication with the enclosure.

In some configurations, the opening assembly further includes a closure positioned proximate the distal end of the chute. In some such configurations, the closure comprises a zipper.

In some configurations, the flexible tank further comprises at least one inlet opening coupled to at least one of the four enclosing walls. The inlet opening is spaced apart from the base fold and providing access to the enclosure.

In some configurations, the at least one inlet opening comprises a pair of inlet openings mounted on opposing sides of the flexible tank.

In some configurations, the flexible tank includes an upper access opening extending through the at least one of the four enclosing walls. The upper access opening is closer to the distal end than to the base fold.

In some configurations, the flexible tank is formed from a coated woven polymer fabric.

In some configurations, a corner seam 27 may be formed where multiple enclosing walls, and/or enclosing walls and the base or other panel meet. In some configurations, this is done after joining adjacent enclosing walls, and, may include wrapping the corner with additional material so as to provide enhanced strength and to provide a seal where the multiple panels meet.

In another aspect of the disclosure, the disclosure is directed to a flexible tank fillable with a liquid comprising a base, a plurality of enclosing walls, an inner brace, an opening assembly, a pair of inlet openings and an upper access opening. The base has an upper surface and a lower surface. The base comprises a rectangle defining four of edges and a perimeter. The plurality of enclosing walls include an enclosing wall extending from each of the four edges and terminating at a distal end, wherein adjacent ones of the enclosing walls are attached to each other, to, together with the base define an enclosure. The inner brace assembly comprises at least one inner support member having a base wall attachment side and an encasing wall attachment side. The base wall attachment side is attached to the base spaced apart from the perimeter. The encasing wall attachment side is attached to at least one enclosing wall spaced apart from the base fold. An opening assembly comprises a chute having a proximal end attached to an enclosing wall and a distal end spaced apart therefrom to define an elongated channel providing access to the enclosure. Each of the pair of inlet openings extending through an enclosing wall on opposite sides of the base, the pair of inlet openings spaced apart from the edge of the base. The upper access opening extends through an enclosing wall. The upper access opening is positioned closer to the distal end of a respective one of the enclosing walls than to the base fold thereof.

In another aspect of the disclosure, the disclosure is directed to a method of filling a flexible tank, the method comprising: positioning a flexible tank on an outside surface; filling the flexible tank through the inlet opening with a liquid; during the filling of the flexible tank, placing at least one inner support member into tension; during the filling of the flexible tank, increasing tension on the least one inner support member to a maximum tension; during filling of the flexible tank, after increasing tension on the at least one inner member, reducing the tension on the at least one inner support member below the maximum; completing the filling to a desired level, wherein the step of reducing the tension occurs prior to or at the time of completing the step of filling.

In some configurations, the step of positioning further comprises the step of: positioning the flexible tank on an incline defining a top of the incline and the bottom of the incline, wherein the inner brace assembly is coupled to a portion of the at least one enclosing wall proximate the bottom of the incline; and precluding the rolling of the flexible tank through cooperation of the liquid and the at least one inner support member during the step of filling.

BRIEF DESCRIPTION OF THE DRAWINGS

The disclosure will now be described with reference to the drawings wherein.

DETAILED DESCRIPTION OF THE DISCLOSURE

Figure 1:
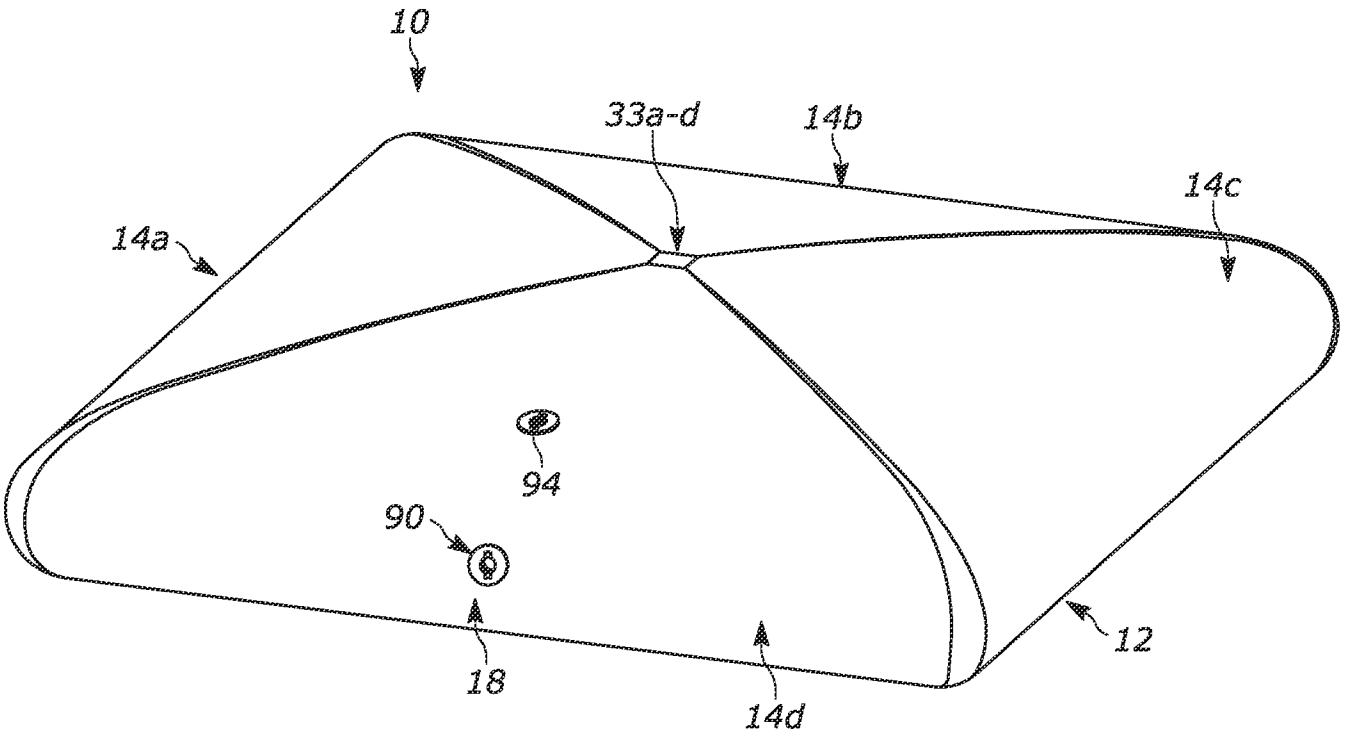
FIG. 1 of the drawings is a perspective schematic representation of a configuration of the flexible tank of the present disclosure, a configuration that does not include a chute.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 10:
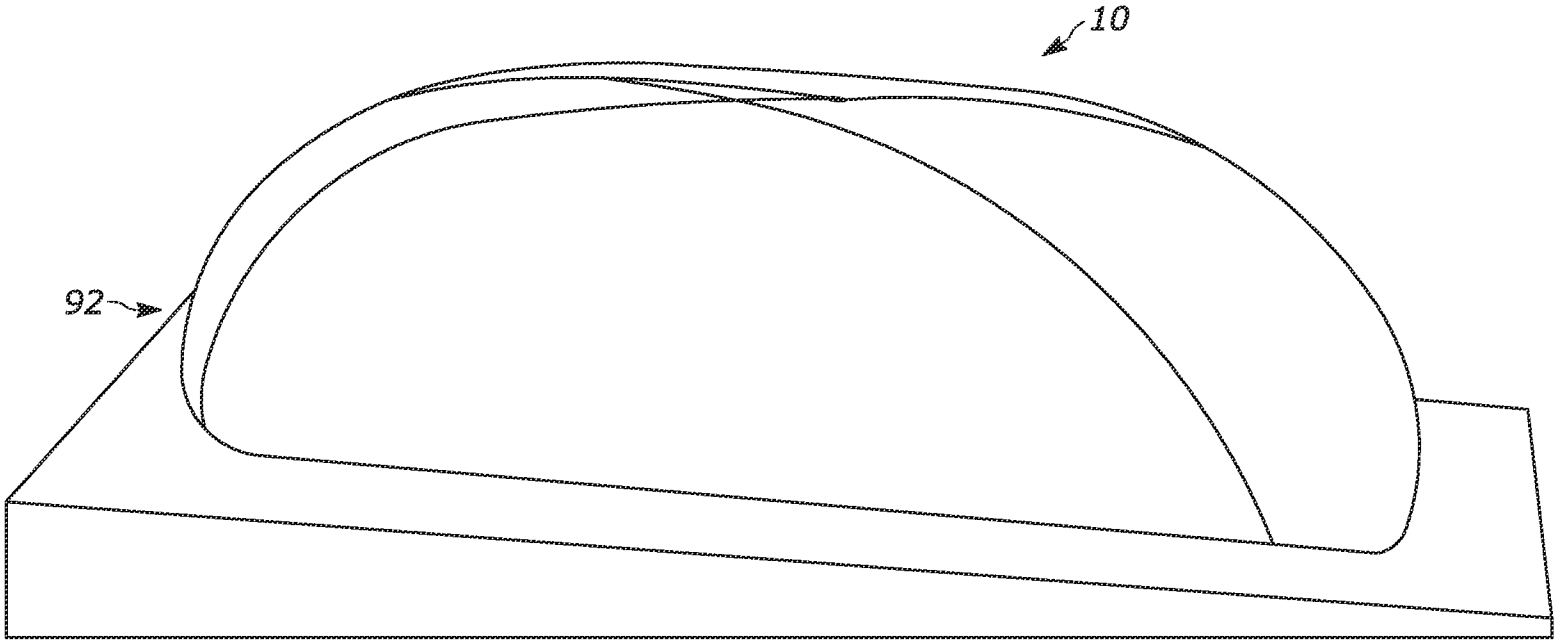
FIG. 10 of the drawings is a perspective view of the flexible tank of the present disclosure, showing a typical filled configuration on an incline of approximately 10%.

Referring now to the drawings, and in particular FIGS. 1 and 10, the flexible tank is shown generally at 10. The flexible tank that is shown is configured to meet the requirements of ATPD 2344 at the time of filing, which specification is hereby incorporated by reference in its entirety. Of course, the present disclosure is not limited to a flexible tank that may or may not pass the requirements of ATPD 2344, nor do any claims implicitly require any claimed flexible tank to meet the requirements of ATPD 2344. It will be understood that the configuration of the flexible tank can preferably be between a volumetric capacity of 100 gallons to 300,000 gallons, and more preferably between 200 gallons and 150,000 gallons, and more preferably between 1000 gallons and 120,000 gallons. One particular configuration is configured for approximately 3000 gallons. It will be understood that with variations in the materials and the construction, approximately 3000 gallons may be, for example, 125% larger than 3000 gallons, while other variations are contemplated as well. It will be understood that when filled with a liquid, such as water, the fill height of a 3000 gallon tank may be on the order of 24 inches to 60 inches, while it will be also be understood that these heights are merely examples, and not limitations.

The flexible tank 10 is shown in FIGS. 1 through 4, collectively, as comprising base 12, enclosing walls 14, inner brace assembly 16, opening assembly 17 and access openings 18. The flexible tank may be made from a woven nylon fabric that is coated with, for example, a polyurethane. One such fabric is available from Coolie Group under the part number L2838UPW, the properties of which are incorporated by reference herein. Of course, other flexible materials, both woven, and nonwoven, as well as coated on the inside and/or outside are contemplated for use, without limitation. Such materials preferably comprise a waterproof material and are generally resistant to any number of materials, chemicals and corrosive, and/or caustic liquids.

Figure 3B:
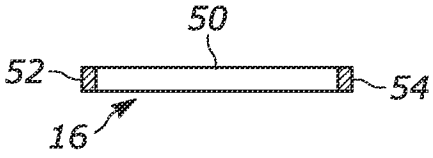
FIG. 3*b* of the drawings is a top plan view of an inner support member that can be attached to portions of the blank of FIG. 3*a;*
Figure 3A:
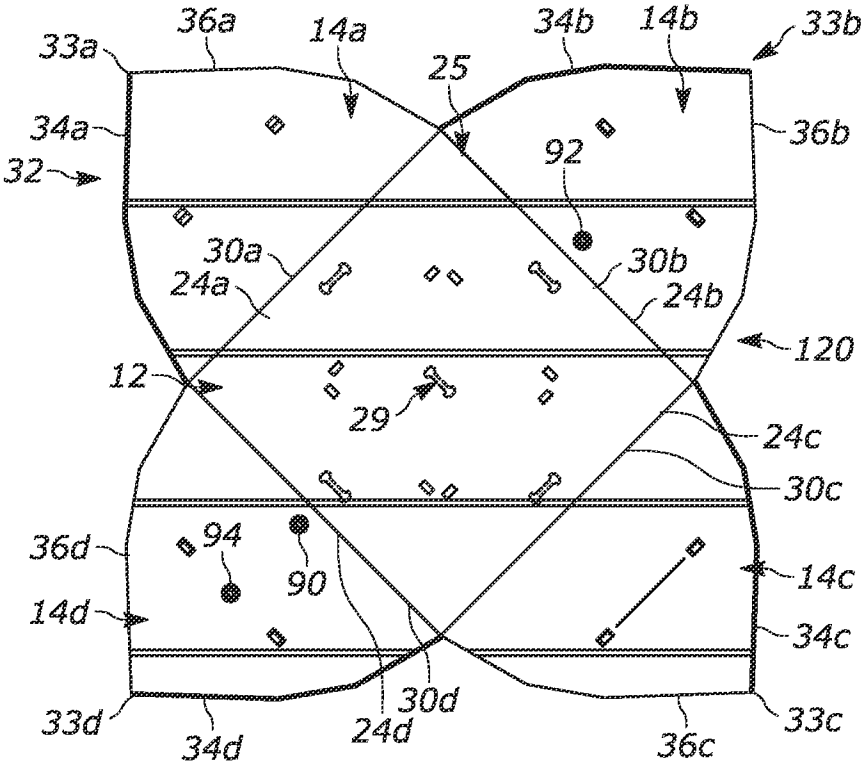
FIG. 3*a* of the drawings is a top plan view of a blank that can be formed into the enclosure of the flexible tank of the present disclosure.
Figure 4:
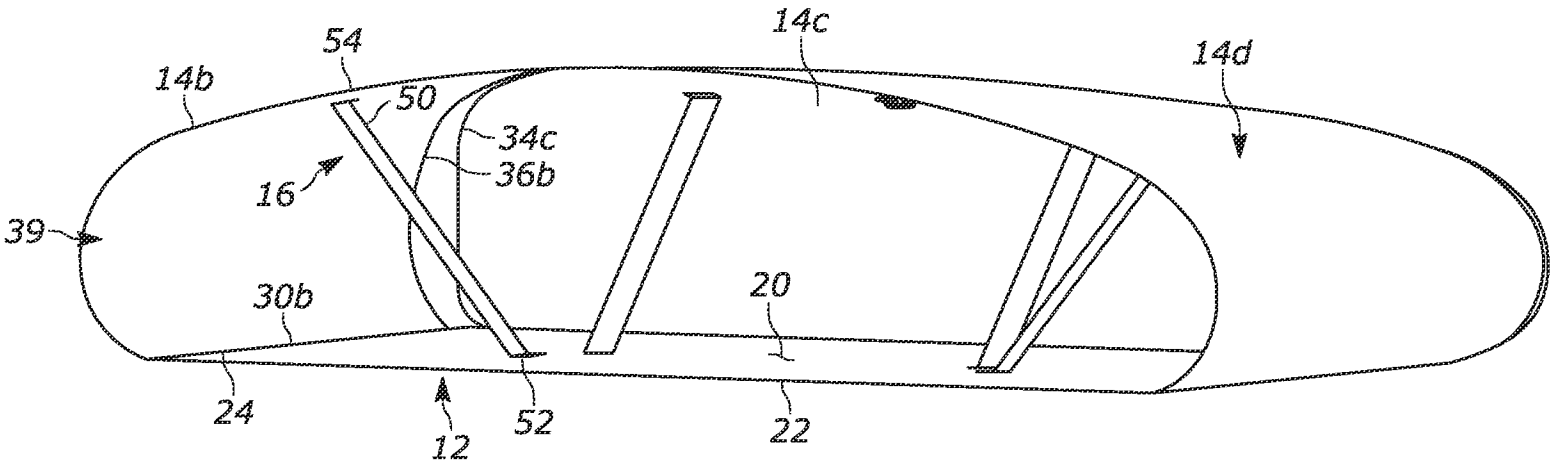
FIG. 4 of the drawings is a cross-sectional perspective view of the flexible tank of the present disclosure.
Figure 5:
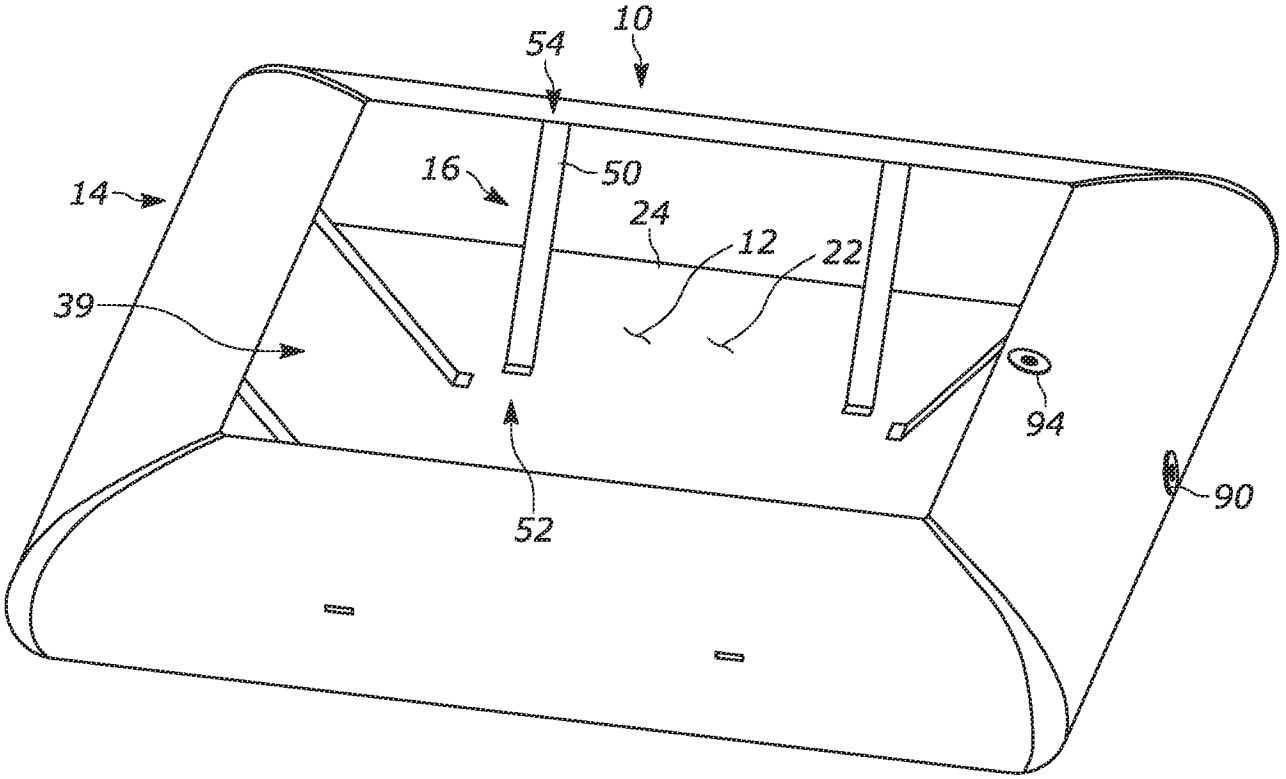
FIG. 5 of the drawings is a cross-sectional perspective view of the flexible tank of the present disclosure.
Figure 6:
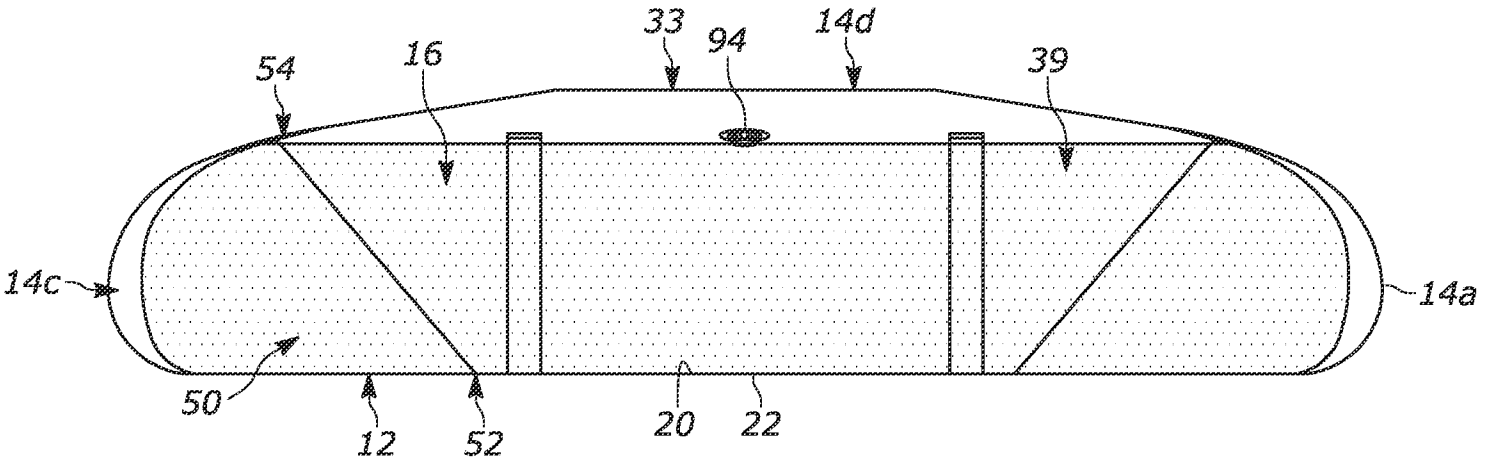
FIG. 6 of the drawings is a cross-sectional view of the flexible tank of the present disclosure, showing the configuration of the inner support members with the flexible tank being filled and/or full.
Figure 11:
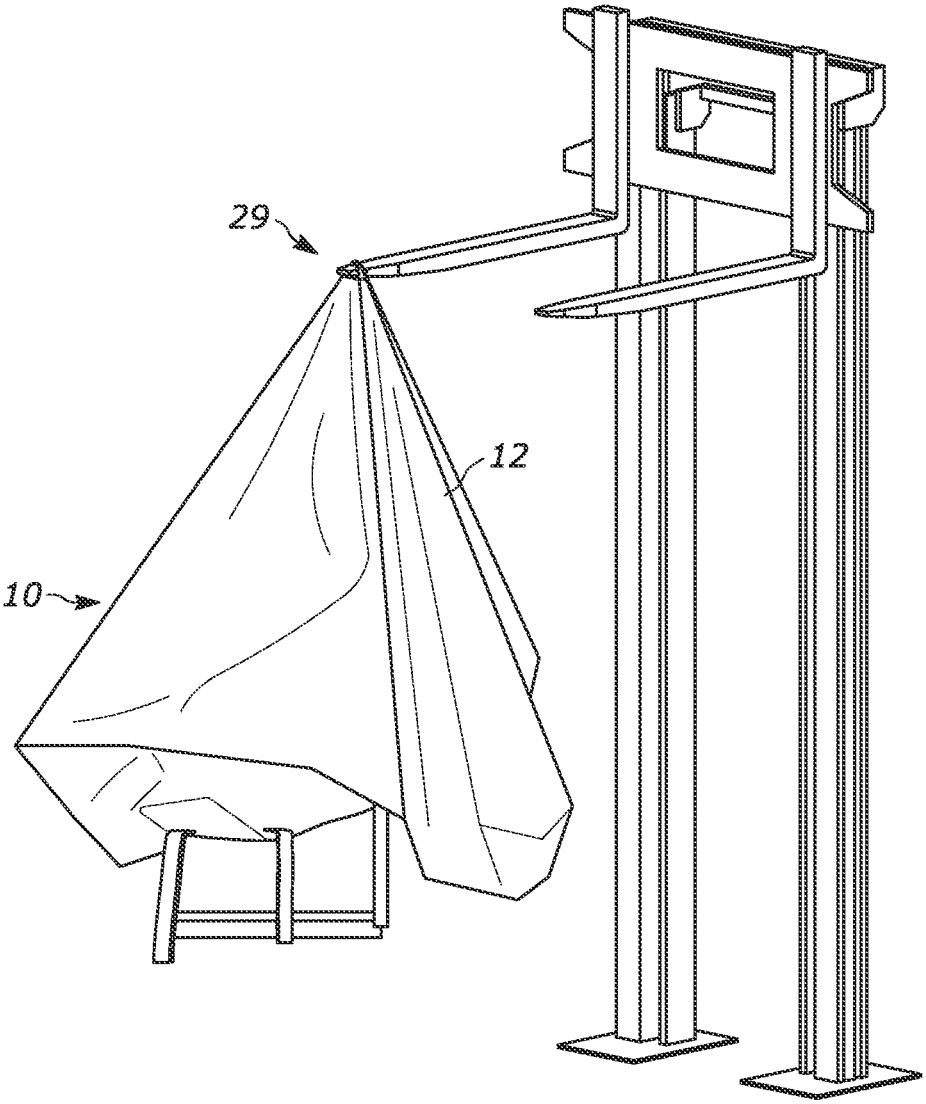
FIG. 11 is a perspective view of the flexible tank being lifted by lower lift hook.
Figure 12A:
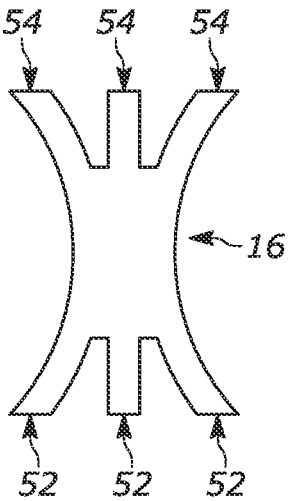
FIGS. 12*a* through 12*d* of the drawings are alternate configurations of the inner support member of the inner brace assembly of the present disclosure.
Figure 12B:
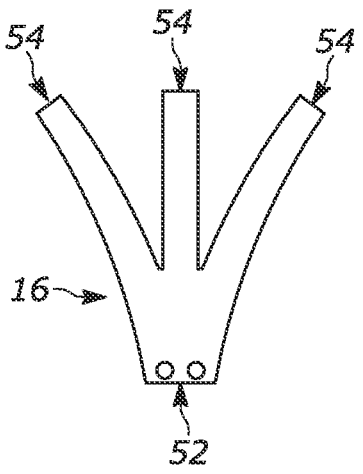
Figure 12C:
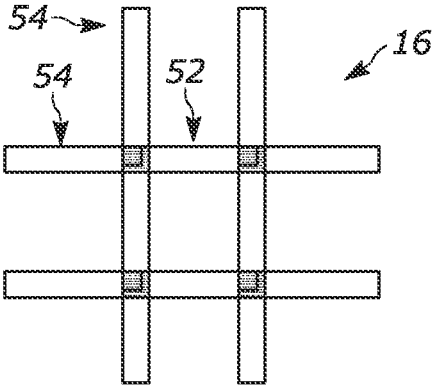
Figure 12D:
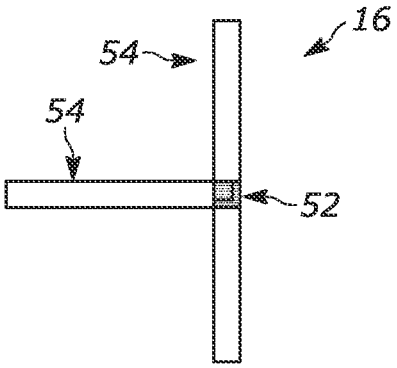

With additional reference to FIGS. 3*a* and 4, collectively, the base 12 includes upper surface 20 and lower surface 22, and generally comprises a substantially uniform material having a substantially uniform thickness and constituency. In the configuration shown, the base 12 defines a square having edges 24*a* through 24*d* defining perimeter 25. A lower lift hook 29 may be attached to the lower surface 22 and may be generally centrally located (FIG. 11). Such a lift hook allows for the lifting of the flexible tank by a cable, a forklift or other structure. Of course, the lift hook can be positioned in a number of different locations, and a number of lift hooks may be employed.

In the configuration shown, the sides are preferably 13 feet or less on each side, and more preferably between 11 and 12 feet long on each side. Overall, in the configuration shown, the area of the base is less than or equal to 169 square feet. Of course, in other configurations, the dimensions may be different. For example, in some configurations, the base may be rectangular, or may be polygonal (three sided or more than five sides). In other configurations, the base may be a rhombus, a parallelogram, a trapezoid, among other configurations. It is further contemplated that the base may be of a circular or elliptical configuration, among others.

The enclosing walls 14 are shown in FIGS. 1 through 4 as comprising four separate enclosing walls 14*a* through 14*d*. The enclosing walls generally combine to define the 39, as will be explained below. Where the configuration is square and generally symmetrical, each of the four separate enclosing walls are substantially identical. Each of the four separate enclosing walls have a base edge 30, and attaching edges 32 which meet at a distal end 33. In the configuration shown, the enclosing wall is generally symmetrical about an enclosing wall axis that extends from the distal end through the midpoint of the base edge 30. The first side edge 34 comprises an arcuate configuration which is outwardly convex and which may be of varying radius of curvature. In some configurations, portions of the first side edge may include inner (i.e., non-curved) regions or sections. For example, the portion of the first side edge 34 proximate the base edge 30 may have a inner or a curved region of a relatively larger radius of curvature than portions that are proximate the distal end 33. In other configurations, the curvature may be substantially continuous.

Similarly, the second side edge 36 is substantially identical to the first side edge and a mirror image thereof in the configuration shown. It will be understood that in other variations, the second side edge may be different than the first side edge as far as being a mirror image thereof about the enclosing wall axis.

As will be understood, in the configuration shown, being a closed top tank, the enclosing walls form both the sides and the top of the flexible tank. Therefore, at some point, a portion of the enclosing walls overlies the footprint of the base and directly faces the base. In other configurations, it is contemplated that an open top tank may be utilized. In still other configurations, it is contemplated that each of the enclosing walls may be of a different configuration, or that opposing ones of the enclosing walls may match, whereas adjacent ones of enclosing walls may be different.

It will further be understood that when the base and the enclosing walls are formed, each wall may be formed separately and then joined through welding or otherwise at the edges 24*a* through 24*d* meeting the base fold 30*a* through 30*d*. As set forth above, for purposes of the present application, the term welding will be understood to mean any number of joining techniques, including but not limited to heat welding, RF welding, ultrasonic welding, gluing, seaming, and other manners in which to form a fluid tight configuration. In other configurations, the entire blank may be first formed from one or more rolls that are joined together in a side by side configuration, wherein the edges 24*a* through 24*d* and the base fold 30*a* through 30*d* are merely folds that are unrelated to any welded seams.

The adjacent attaching edges are joined together through welding or otherwise to form the enclosure 39. That is, the first side edge of an enclosing wall is attached to a second side edge of an adjacent enclosing wall. This is repeated until the walls are all joined to define the enclosure 39. A suitable blank 120 is shown in FIG. 3*a*. To provide additional strength, where the distal ends 33*a* through 44*d* meet, another reinforcement in the form of a separate piece of material 28 may be welded thereover. It will be understood that such a separate piece may be welded to either one or both of the inner surface and the outer surface of the enclosing walls. Furthermore, the corners where adjacent enclosing walls meet with the base may be further reinforced through relatively large corner seams, such as corner seam 27. Corner seam 27 is typically formed after the vertical seam joining adjacent enclosing walls is completed, and, typically includes wrapping the corner with additional material so as to provide enhanced strength and to provide a seal where the multiple panels meet.

It is contemplated that the enclosing walls may be formed from panels in excess of four panels, and that it is contemplated that a top panel may be formed from a separate member that is attached to a plurality of what are defined as sidewalls. It will be understood that regardless of the panels, that form the remaining portion of the enclosure 39, for purposes of the disclosure, the panels other than the base are defined as enclosing panels, as the form the remainder of the enclosure that is not formed by the base. In some configurations, such as an open top circular or polygonal configuration, a single enclosing wall may encircle the perimeter of the base (in some such configurations a separate enclosing wall may be used as a top cover). In other configurations, multiple enclosing walls are seamed together.

It will further be understood that the exact line that separates a base from the enclosing wall may comprise a transition range and may have a width as opposed to a specific point of intersection, as the base and the enclosing walls are flexible in nature and have varying shape configurations while being filled and the like. In other instances, the delineation between the base and the enclosing walls may comprise a sharp and relatively narrow meeting point of an edge and base fold.

The inner brace assembly 16 is shown in FIGS. 3*b* through 6 as comprising at least one inner support member positioned within the enclosure 39. In the configuration shown, the inner support member 50 has a base wall attachment side 52 and enclosing wall attachment side 54. The base wall attachment side 52 is attached to the base wall through welding or other attachment means and the enclosing wall attachment side 54 is attached to the enclosing wall through welding or other attachment means. Preferably, the inner support member 50 comprises a strip of fabric (in many instances, the same fabric material from which the base and/or the enclosing walls are formed) of a substantially uniform width.

The base wall attachment side is attached to the base in a position that is spaced apart from the respective edge 24*a* through 24*d* toward a central portion of the base. And, the enclosing wall attachment side 54 is attached to the enclosing wall spaced apart from the base fold 30. It will be understood that there are a range of positions for each of the locations that the base wall attachment side and the enclosing wall attachment side are coupled to the respective base wall and enclosing wall, with the understanding that when placed on an incline, sufficient liquid weight is proximate the base wall attachment side to counter the rolling (or pulling force) of the enclosing wall to preclude the enclosing wall from rolling over itself and allowing the bag to roll down an incline. At the same time, preferably, the enclosing wall attachment side is positioned on the enclosing wall spaced apart from the base fold so as to provide a pulling force relative to the enclosing wall during filling sufficient to resist the rolling down an incline, while, when filled to be in a substantially relaxed configuration (that is being in no tension to a low tension—i.e., less than the maximum tension placed on the same during the filling process) so as to preclude damage to the base, and/or the enclosing walls (or to itself) when the flexible tank is filled sufficient to have liquid cover the base and to initiate coverage or extending over the enclosing walls. Preferably, once the flexible tank is filled sufficient to have liquid cover at least a majority of the base, and more preferably 70% of the base, and more preferably 80% of the base and more preferably 90% of the base, and more preferably the entirety of the base, further filling reduces the tension in the inner support member. And, preferably, at some point in the filling process, the tension is removed from the inner support member.

In the configuration shown, the inner support member is joined to the base about 25% of the distance between the opposing edges of the base, and the inner support member is joined to the enclosing wall approximately 55% of the distance between the base fold and the distal end. As such, as the container is filled, the inner support member forms an angle relative to the base, with the angle changing as the bag is filled, and eventually, being released of tension, preferably. It will be understood to one of skill in the art that the particular placement may be varied depending on the configuration of the flexible tank, and any incline that the flexible tank is positioned. Such a configuration has been found to be suitable for an 10% grade. It is further contemplated that the maximum tension in the inner support member is reached during filling and prior to completed filling to the desired level, at which time the tension reduces from the maximum tension. For the configuration of a 3000 gallon, it is contemplated that the inner support member may be positioned on the base approximately 36 inches from the edge of the base, and may be approximately 47 inches in length. In such a configuration, with the height and dimensions of the enclosing walls, the inner support member is in a relaxed (i.e., untensioned) condition when full in configurations that are at least up to a 10% grade, and remain relaxed throughout filling at least on a flat surface, if not surfaces of slight grade.

It is contemplated that a plurality of inner support members may be associated with each enclosing wall 14. In the configuration shown, a pair of inner support members span from the base to each of the enclosing walls 14*a* through 14*d*, and that they are spaced apart uniformly from each other. Wherein the sides are larger, additional inner support members may be utilized. For example, three or more inner support members may extend from the base to each of the enclosing walls in a spaced apart configuration. It will be understood that the inner support member may be similarly configured for each of the enclosing walls in the configuration shown, so that, preferably, the performance is similar regardless of which of the edges is at the lowest point of an inclined surface onto which the flexible tank is positioned. In some configurations, if it is known that only some of the edges will form the lowest point of an inclined surface, certain enclosing walls may be free from coupling with the base.

Figure 7:
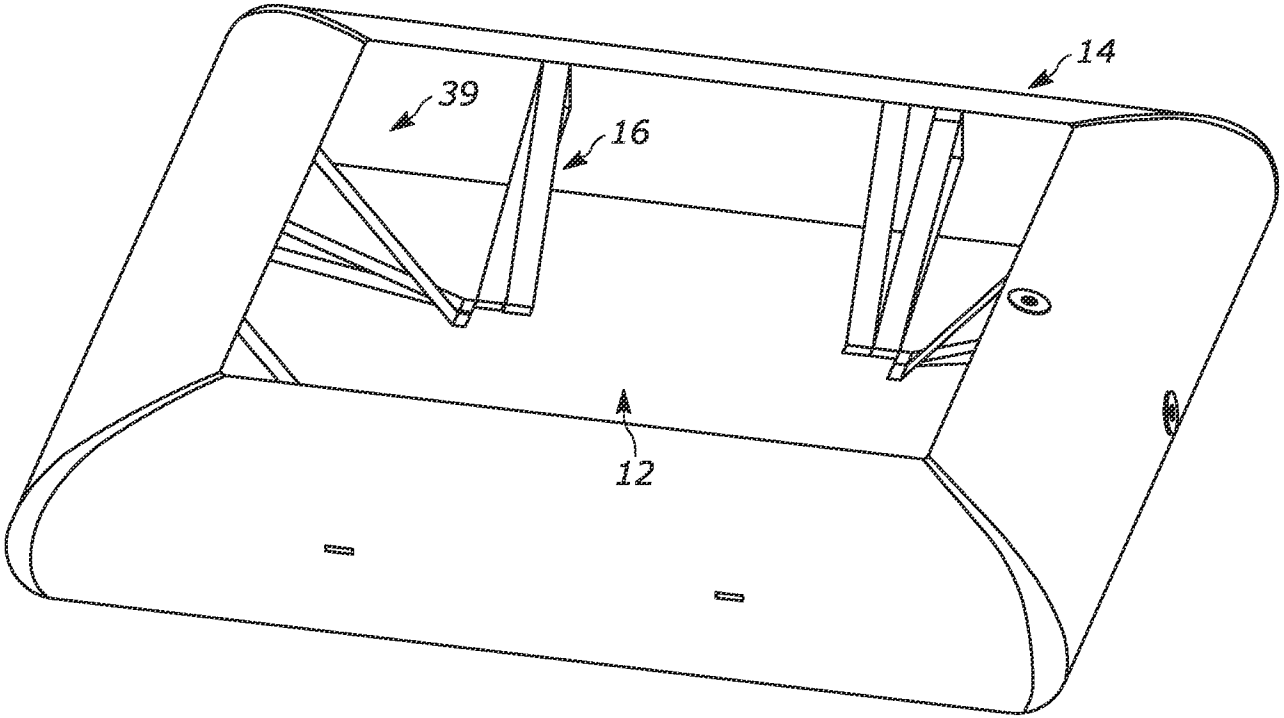
FIG. 7 of the drawings is a cross-sectional perspective view of the flexible tank of the present disclosure.

It is further contemplated that in some configurations, it may be advantageous to have a plurality of inner support members that emanate from substantially the same spot on the base extend to the same enclosing wall at successively greater distance from the base fold of the enclosing wall. For example, and as is shown in FIG. 7, in some configurations, three separate inner support members extend from a similar location on the base to the same enclosing wall at different distances from the base fold of that wall.

It will further be understood that the individual straps may collectively form a web or singular structure which is collectively coupled to the base and with portions attached to the enclosing walls. In other configurations, the inner support members may be formed from other materials, such as cables, ropes or the like, which can be welded, clipped, fastened or otherwise coupled to the respective base and enclosing walls. Larger material sections may be utilized to form the inner support member in the form of a baffle or the like between the base and the enclosing walls. In other configurations, a inner support member may branch in one or both directions so as to be coupled to the base and/or the enclosing walls at multiple locations. Various contemplated configurations are shown in FIGS. 12*a* through 12*d*, by way of illustration solely, and as being exemplary. It will be understood that by no means are the configurations shown herein limiting as countless variations thereto are contemplated.

Furthermore, as set forth above, some flexible tanks have enclosing walls that are formed from a one or more sidewalls and one or more top walls. In such a configuration, it will be understood that the one or more sidewalls and one or more top walls form the enclosing walls and the enclosing wall attachment side is attached to the enclosing walls which may comprise a sidewall or a separate top wall that is attached to the sidewall as such walls are a part of the enclosing walls.

Figure 2:
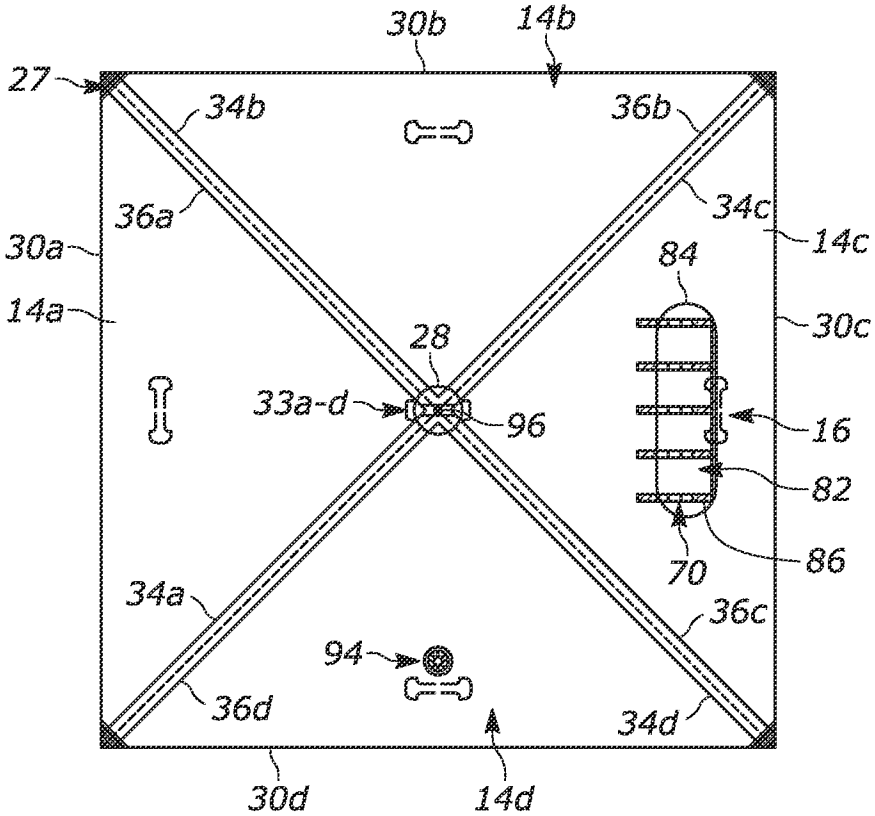
FIG. 2 of the drawings is a top plan view of a configuration of the flexible tank of the present disclosure.
Figure 8:
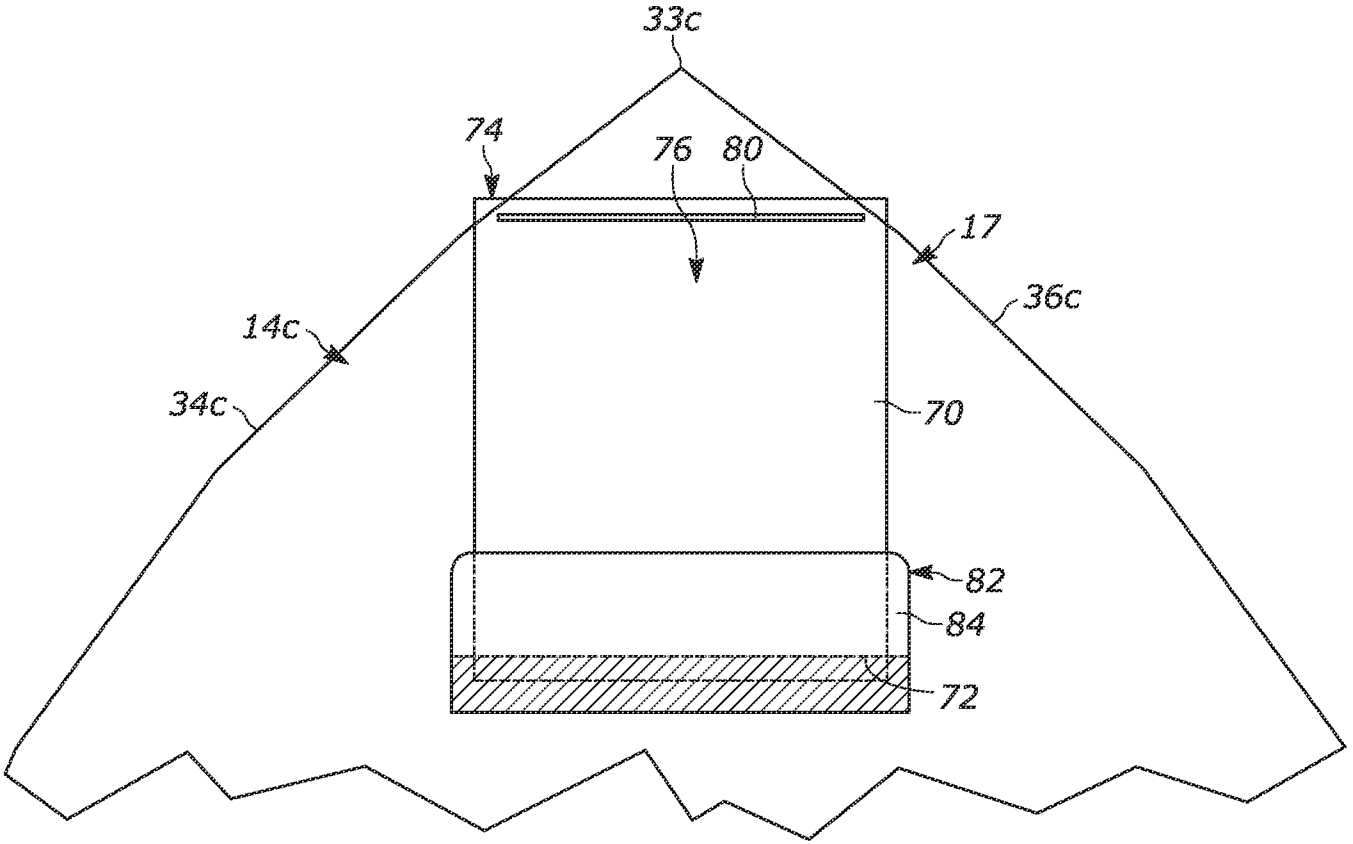
FIG. 8 of the drawings is a top plan view of the opening assembly of the tank of the present disclosure.
Figure 9:
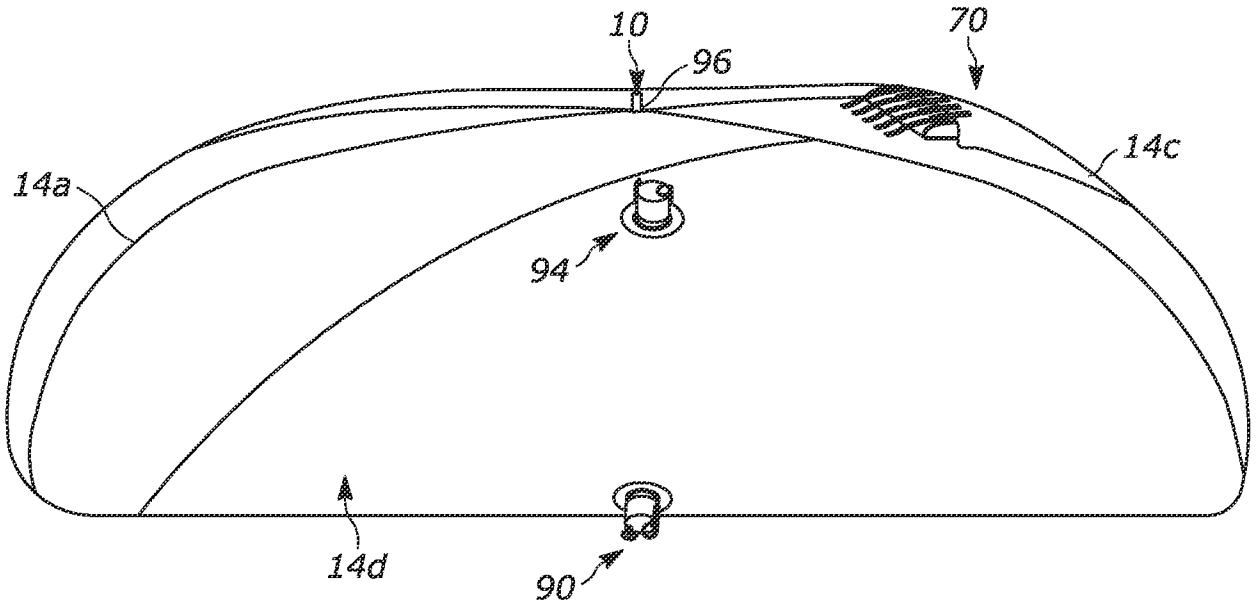
FIG. 9 of the drawings is a perspective view of the flexible tank of the present disclosure, showing a typical filled configuration.

The opening assembly 17 is shown in FIGS. 2 and 8, collectively, as comprising chute 70. The opening assembly provides ingress into the enclosure 39 for purposes of cleaning, mixing with a mixing paddle or other mixer structure, and, preferably, for an individual to be able to enter into the enclosure 39 for purposes of, for example, cleaning and the like. In the configuration shown, the chute mates with the flexible tank at a slit on one of the enclosing walls 14 generally parallel to the base fold and spaced apart therefrom sufficient so as to be proximate the upper fill line (or above the upper fill line) so as to preclude the outpouring of contents from within the enclosure. The chute 70 has a proximal end 72 and a distal end 74 wherein the chute defines an elongated channel. In the configuration shown, the chute is formed from one or two panels that are seamed on opposing sides (or heat sealed).

A closure 80 may extend across the opening to the chute at or near the distal end of the chute 70. In the configuration shown, the closure comprises a zipper that extends across from side to side of the chute at or near the distal end. The zipper is preferably a waterproof zipper. In other configurations, magnets may be utilized to form the closure, or hook and loop fasteners, snaps or other structures.

The closure can be stowed when not in use. In some configurations, a tie down subassembly 82 can be provided. The tie down subassembly 82 includes a protective cover that can be extended over the chute (with the chute being rolled up or folded up prior to extending the protective cover). Additionally, tie down straps can extend over the protective cover generally perpendicularly to the chute to maintain the chute in the folded or rolled up configuration until it is desired to use the chute. While tie down straps are shown (with clips) other types of straps are contemplated, such as hook and loop fasteners, snaps, double d-ring straps, among other structures. In other configurations, the protective cover itself may form part of the strap or may be directly attached to the enclosing wall after covering the chute.

The access openings 18 comprise a plurality of openings that are positioned at strategic locations about the enclosing walls. For example, a pair of inlet openings 90, 92 are positioned on opposing enclosing walls spaced apart from the base fold, while being closer to the base fold than to the distal end. an upper access opening 94 is disposed on an enclosing wall proximate the upper fill line. In the configuration shown, the upper access opening 94 is on the same wall as one of the inlet openings. The upper opening is preferably on an enclosing wall that is not the same wall having the chute. However, in some configurations, the two structures may be on the same walls, while being spaced apart.

In the configuration shown, the inlet openings and the upper access opening each comprise a spout having a flange and an upstanding cylindrical member that may be threaded on an outer surface thereof. In some configurations, a pair of flange components are coupled together to sandwich the enclosing wall therebetween forming a seal therewith. In other configurations, a integrally molded spout may be provided with a 2" opening, for example, and external threads. The integrally molded spout may comprise a polymer that is compatible with the enclosing wall so as to be welded thereto. Additional layers of material may be further attached to the spout to reinforce the region therearound.

Further a vent 96 (such as a mushroom vent or the like) may be positioned where the distal ends of the enclosing walls meet, for example. It will be understood that in some configurations, the vent may be omitted, or multiple vents of varying construction may be utilized.

In operation, the flexible tank can be folded or rolled into a small footprint and transported where needed for use. For example, the configuration shown for a 3000 gallon flexible tank has the weight of less than 140 pounds, and can fit in a space of 30"×30"×35". It is contemplated that such a flexible tank may be transported in a valise or the like. It will be understood that at 3000 gallon tank may be configured, in many instances to hold about 125% of the stated capacity (or greater or lesser amounts relative to the stated capacity).

Once a desired location is reached, the flexible tank can be released and unfolded/unrolled so that the base is on the ground. It will be understood that the flexible tank includes an inner brace assembly to preclude rolling when the flexible tank is positioned on an incline. As such, the deployment will be described in an inclined configuration for purposes of illustration, and with reference additionally to FIG. 10. For example, the flexible tank is positioned on a 10% grade, with one of the base folds being at the lowermost position of the incline. Preferably, an enclosing wall that does not have an inlet, or the chute as it is possible to damage the inlet. Additionally, it is possible to have the chute further below a waterline if it is at the lower side of an incline.

The user begins to fill the flexible tank through one or both of the inlets. Initially the liquid, in this example, for example, water (not to limit the flexible tank to holding water) rushes down the incline and builds at and near the meeting of the base and the enclosing wall. As the water level increases, the enclosing wall begins to bulge outwardly. As the bulge increases, and as the water level increases, eventually, sufficient water level is pushing against the enclosing wall that without the inner brace assembly, the flexible tank would begin to roll over itself and down the incline. In the present disclosure, as the water level increases, eventually water covers and/or approaches the area of the base proximate the base wall attachment side of the inner support member. At the same time, the encasing wall the enclosing wall begins to pull the inner support member at the encasing wall attachment side. The inner support member becomes pulled taut and is under a tensile load. With the strategic position attachment of the inner support member to the base and to the enclosing wall, the force of the water pushes against the enclosing wall in an attempt to initiate rolling. This rolling force is countered by the water weight at the base proximate and/or surrounding the base wall attachment side through the tension of the inner support member. And, sufficient water weight counters the tendency to roll due to the force against the enclosing wall such that the weight of the water, the remainder of the flexible tank and the pulling/resisting force of the inner support member precludes the rolling of the flexible tank down the incline.

As the water further fills the flexible tank, eventually, the entirety of the base is covered with water and the water height begins to build. As the height builds, the other enclosing walls bulge outwardly and begin to pull inwardly the enclosing wall that is at the lower most of the incline. At such time, the tension on the inner support member will begin to be reduced as the force of the water is countered, and, as the flexible tank is reshaped, the base wall attachment side and the enclosing wall attachment side begin to move closer to each other. Preferably, when the flexible tank is filled to a certain level (i.e., preferably between 40% and 100%, more preferably between 60% and 100% and more preferably between 70% and 100%), the inner support member is free of tension and distance between the base wall attachment side and the encasing wall attachment side is less than the effective length of the inner support member. Thus, the inner support member is, preferably, no longer in tension. The release of this tension (or at least the substantial reduction of tension, preferably less than 30% of the maximum tension experienced during a fill at a maximum desired incline, and more preferably less than 20% and more preferably less than 10% and more preferably less than 5%) minimizes possible damage of the base and/or enclosing walls proximate a base wall attachment side and/or a enclosing wall attachment side, as well as damage to the inner support member over the life of the flexible tank and the repeated fill and empty cycles thereof on flat surfaces and on surfaces of various inclines. In the 3000 gallon example discussed herein, at a fill of 125% of 3000 gallons, the height of the flexible bag is between 47 inches and 56 inches (while not being limited thereto). Over time, the height will tend to reduce due to relaxation of the fabric and slight stretching thereof, it is believed. It will be understood that at 125% of the capacity of a flexible tank rated for 3000 the inner support members may be in slight tension, whereas close to 100% (i.e., 100% to 110% or more, there may be no tension on the inner support members).

It will be understood that in some configurations, such as, for example and not to be deemed limiting, when the flexible tank is on a flat surface or on an incline that is, for example, less than 2% (exemplary an not to be deemed limiting), it is possible for the inner support member to remain loose and to not be placed into tension during the filling process. Indeed, regardless of the incline (within the limits of the flexible tank for the particular application), it is entirely possible that some of the inner support members may be loose and may have substantially no tension thereon. Preferably, the tension when filled is less than a maximum tension that is observed during filling, that is, at some point or range between initiating filling and completing filling.

Once filled, or during the filling process, a user can open the chute and insert chemicals. For example, such chemicals can be spilled into the chute from a larger container (i.e., 5 gallon bucket, or the like) into the flexible tank. A paddle or other stirring device can be inserted into the chute to mix the chemicals (which may be solids or liquids or otherwise).

Additionally, a user can open the upper access opening so as to insert chemicals or other constituents, or to withdraw samples or other quantities of liquid. As the upper access opening is relatively high, there is minimal, if any loss of liquid from within the enclosure through the upper access opening.

The user can empty contents through the inlet openings (that is, they can function as outlets). Once emptied, or significantly reduced, a user may climb into the enclosure through the chute to, for example, clean the inside of the flexible tank.

It will be understood that depending on the size of the flexible tank, the flexible tank may include multiple chutes, multiple inlet openings, multiple outlet openings, multiple vents or other structures which allow for ingress and egress from the flexible tank. In addition, larger tanks may have increased numbers of inner support members between the base and any one enclosing wall as well as multiple extending from the same region of either the enclosing wall or the base and to the other of the enclosing wall or the base.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A flexible tank fillable with a liquid comprising:

a base having an upper surface and a lower surface, the base defining a rectangular configuration defining four edges, four corners and a perimeter;

four enclosing walls, each enclosing wall having a base fold extending from each of the four edges base, each enclosing wall further including opposing attaching edges extending from the base fold toward a distal end, wherein the opposing edges have an outwardly convex configuration and adjacent ones of opposing attaching edges of adjacent enclosing walls are attached to each other to define the enclosure, and a corner seam at each corner seaming respective pairs of the four enclosing walls that are adjacent to each other and the base; and an inner brace assembly comprising at least four inner support members, each inner support member having a base wall attachment side and an encasing wall attachment side, wherein the base wall attachment side is attached to the base spaced apart from the perimeter and wherein the encasing wall attachment side is attached to the at least one enclosing wall spaced apart from the base fold, and wherein at least one of the at least four inner support members is attached to each of the four enclosing walls.

2. The flexible tank of claim 1 wherein:

at least one of the at least four inner support members is placed in tension during filling with a liquid; and may be released of tension by further filling with a liquid.

3. The flexible tank of claim 2 wherein:

when filled to a predetermined level with a liquid the at least one inner support member that was placed in tension is in less tension than during filling.

4. The flexible tank of claim 1 wherein, when the base is on a flat surface, at least one of the at least four inner support members is not in tension throughout the filling of the enclosure with a liquid to a predetermined level.

5. The flexible tank of claim 1 wherein the at least four inner support members comprises at least two inner support members extending from the base to each of the four enclosing walls.

6. The flexible tank of claim 1 wherein the at least two inner support members comprise elongated strips of a woven fabric.

7. The flexible tank of claim 1 wherein each of the four enclosing walls are substantially identical in configuration, with the base comprises a square.

8. The flexible tank of claim 1 further comprising an opening assembly comprising a chute having a proximal end attached to at least one enclosing wall and a distal end spaced therefrom, the chute defining an elongated channel placeable in fluid communication with the enclosure.

9. The flexible tank of claim 8 wherein the opening assembly further includes a closure positioned proximate the distal end of the chute.

10. The flexible tank of claim 9 wherein the closure comprises a zipper.

11. The flexible tank of claim 1 further comprising at least one inlet opening coupled to at least one of the four enclosing walls, the inlet opening being spaced apart from the base fold and providing access to the enclosure.

12. The flexible tank of claim 11 wherein the at least one inlet opening comprises a pair of inlet openings mounted on opposing sides of the flexible tank.

13. The flexible tank of claim 11 further comprising an upper access opening extending through the at least one of the four enclosing walls, the upper access opening being closer to the distal end than to the base fold.

14. The flexible tank of claim 1 wherein the flexible tank is formed from a coated woven polymer fabric.

15. A flexible tank fillable with a liquid comprising:

a base having an upper surface and a lower surface, the base defining a rectangular configuration defining four edges, four corners and a perimeter;

four enclosing walls, each enclosing wall having a base fold extending from each of the four edges base, each enclosing wall further including opposing attaching edges extending from the base fold toward a distal end, wherein the opposing edges have an outwardly convex configuration and adjacent ones of opposing attaching edges of adjacent enclosing walls are attached to each other to define the enclosure, and a corner seam at each corner seaming respective pairs of the four enclosing walls that are adjacent to each other and the base; and an inner brace assembly comprising at least four inner support members, each inner support member having a base wall attachment side and an encasing wall attachment side, wherein the base wall attachment side is attached to the base spaced apart from the perimeter and wherein the encasing wall attachment side is attached to the at least one enclosing wall spaced apart from the base fold, and wherein at least one of the at least four inner support members is attached to each of the four enclosing walls;

an opening assembly comprising a chute having a proximal end attached to one of the four enclosing walls and a distal end spaced apart therefrom to define an elongated channel providing access to the enclosure;

a pair of inlet openings, each of the pair of inlet openings extending through one of the four enclosing walls on opposite sides of the base, the pair of inlet openings spaced apart from the edge of the base; and an upper access opening extending through one of the four enclosing walls, the upper access opening being positioned closer to the distal end of a respective one of the enclosing walls than to the base fold thereof.

* * * * *